United States Patent [19]

Roumieu

[11] Patent Number: 4,842,254

[45] Date of Patent: Jun. 27, 1989

[54] APPARATUS FOR PURIFYING LITHIUM

[75] Inventor: Raymond Roumieu, Valence, France

[73] Assignee: Metaux Speciaux S.A., Paris, France

[21] Appl. No.: 133,882

[22] Filed: Dec. 16, 1987

Related U.S. Application Data

[62] Division of Ser. No. 852,552, Apr. 16, 1986, Pat. No. 4,738,716.

[30] Foreign Application Priority Data

Apr. 24, 1985 [FR] France ..... 85 06606

[51] Int. Cl.[4] ..... F27D 11/02

[52] U.S. Cl. ..... 266/88; 266/94; 266/149; 266/234

[58] Field of Search ..... 266/234, 149, 88, 94

[56] References Cited

U.S. PATENT DOCUMENTS 4,407,488 10/1983 Wanetzky et al. ..... 266/149

4,695,319 9/1987 Miura et al. ..... 75/63

*Primary Examiner*—Melvyn J. Andrews

*Attorney, Agent, or Firm*—Dennison, Meserole, Pollack & Scheiner

[57] ABSTRACT

The invention relates to an apparatus for purifying lithium, formed by a sealed enclosure comprising a heated upper portion 1 provided with a container 9 in which the molten lithium 11 is agitated and from which the impurities evaporate, and a cooled lower portion 13 provided with a condensation surface 17 and a pipe means 16 for producing a depression in the lower portion. The invention is used in the purification of lithium, and in particular, for separation of lithium from sodium and potassium impurities.

2 Claims, 1 Drawing Sheet

APPARATUS FOR PURIFYING LITHIUM

Figure 1:
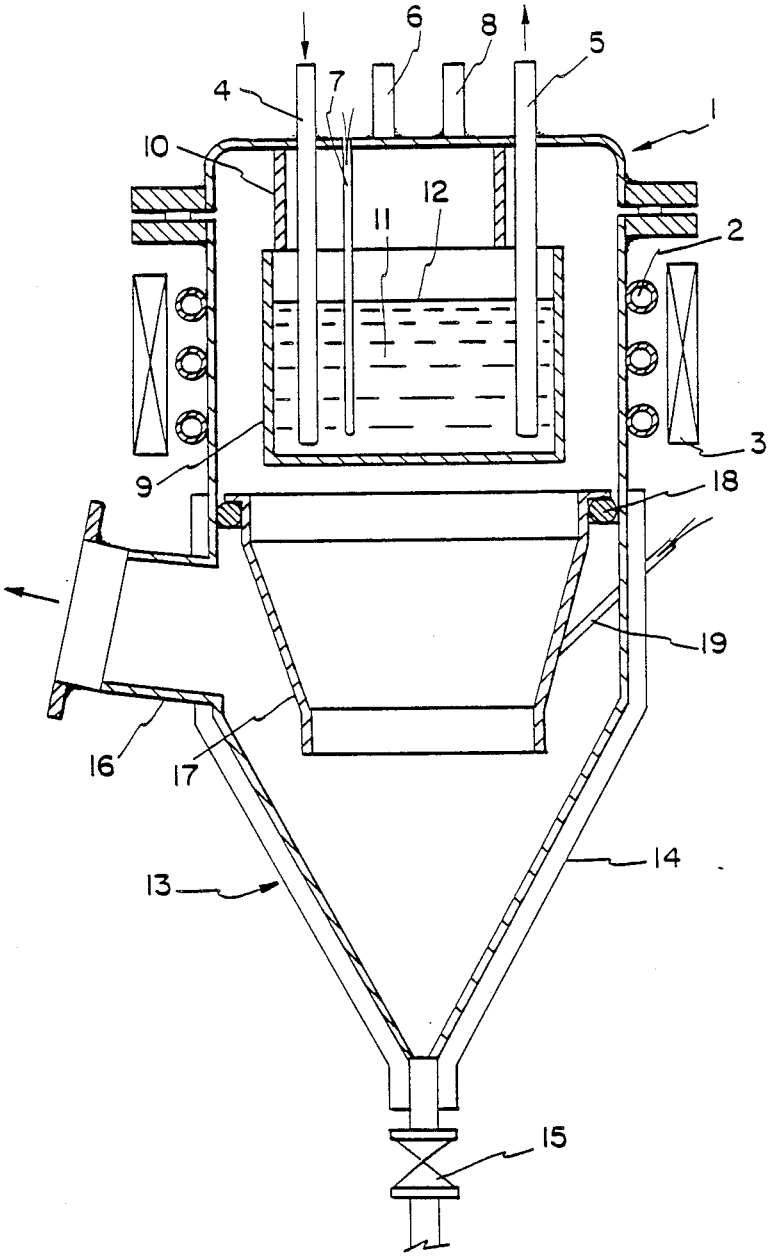

This is a divisional of co-pending application Ser. No. 852,552 filed on Apr. 16, 1986 now U.S. Pat. No. 4,738,716.

The present invention relates to a process and an apparatus for purifying lithium in particular in respect of sodium and potassium.

It is known that lithium is an attractive material in particular in the aeronautical industry where, when alloyed with aluminium, it makes it possible to manufacture massive plates and components of light weight, and to improve certain mechanical characteristics of conventional alloys.

However, the lithium which is used for that purpose must be in a suitable state of purity and in particular it must contain very little alkali metals such as sodium and potassium as those elements cause downgrading in particular of the mechanical characteristics of aluminium alloys.

Now, lithium which is produced chemically or electrochemically generally contains sodium which comes from the raw material and potassium in particular when it is produced electrolytically as that procedure in most cases involves using baths of metal salts containing potassium chloride and that compound undergoes partial dissociation upon electrolysis, giving rise to a deposit of potassium, simultaneously with lithium.

It is therefore found necessary to effect an operation for removing those elements from lithium before undertaking the manufacture of alloys with aluminium.

It is known from the treatise on Mineral Chemistry by Pascal, Volume II, 1st section, 1966 edition, page 25, that it is possible to purify lithium in respect of potassium by distilling the hydride at about 700° C., or also simultaneously to reduce the proportion of sodium and potassium by distilling the lithium at about 400° to 450° C. under a very low pressure of the order of about $1 \cdot 10^{-3}$ Pascal.

However, those processes require complete vaporisation of the lithium, thus giving rise to a relatively substantial level of consumption of heat energy. In addition, as the coefficient of separation of those metals is low, the distillation operation must be carried on slowly if the appropriate level of purity is to be obtained. That results in a low level of productivity but nonetheless does not prevent a substantial loss of lithium both in polluted form and by volatilisation.

In addition, the trickle flow of liquid lithium over the walls of the distillation column is the cause of serious corrosion of the equipment which is generally made of stainless steel, and that can give rise to latent pollution in the metal produced.

It is for that reason that, the applicants having noted those disadvantages, they sought and discovered a process which is much quicker, gives rise to less pollution and is more economical than the preceding processes, as well as an apparatus for carrying out said process.

The process according to the invention is characterised by agitating the bath formed by the lithium to be purified, which was melted in an inert atmosphere, selectively evaporating the impurities at a temperature of between 400° and 700° C. under a pressure of lower than 10 Pascal, and condensing them at a temperature of lower than 100° C.

Thus, after the mass of lithium to be purified has been melted under conditions of being protected from the air in order to avoid oxidation thereof, that process comprises subjecting the bath which is formed in that way to agitation so as permanently to renew the free surface that it has in the container in which it was initially placed. The agitation effect may be produced by any mechanical means such as an agitator or electrical means such as electromagnetic coils which are supplied with alternating current and which induce in the bath electrical forces which, by interaction with the magnetic field that they generate, develop Laplace forces which are such as to cause agitation. At the same time as the bath is agitated, the metal is maintained at a temperature of between 400° and 700° C. and the atmospheric pressure at the free surface of the bath is reduced to a value of lower than 10 Pascal so as to cause evaporation at that point.

The temperature may be maintained at the specified value by means of heating elements which are disposed at the end of the bath so as to prevent them from being corroded by the lithium. As regards the reduced pressure, it is produced by any suitable pumping apparatus such as for example the association of a vane-type and a diffusion pump.

The temperature range used derives from the fact that a higher temperature increases the losses of lithium while a lower temperature reduces the rate of evaporation. In that range, a pressure of lower than 10 Pascal must be maintained in order to provide for sufficient evaporation. However, those conditions which are most favourable to carrying out the process correspond to a temperature of between 530° and 570° C. and a pressure of between $1 \cdot 10^{-1}$ and $1 \cdot 10^{-3}$ Pascal.

Evaporation which is carried out under those conditions is then found to be highly selective, that is to say, it involves virtually exclusively the impurities: sodium and potassium, without giving rise to substantial evaporation of lithium, and that effect is achieved with relatively high rates that thus make it possible to achieve a suitable level of productivity. By virtue of the nature of the means according to the invention, the problem of corrosion and pollution which follows on therefrom is eliminated.

The process also comprises a condensation phase which permits impurities which were evaporated to be collected in the liquid or solid state. The condensation operation is carried out at a temperature of lower than 100° C. and preferably lower than 50° C. In fact it is desirable to provide the condensation effect at the lowest possible temperature in order to be able to promote evaporation and to maintain a rate that is compatible with the required level of productivity.

The invention also comprises an apparatus for carrying out the process.

The apparatus is characterised in that it comprises a metal enclosure which is sealed with respect to the ambient air and which is formed by:

an upper portion equipped with means for heating, agitating, supplying and drawing off lithium and for measuring level and temperature, and within which is disposed a container in which the lithium presents an evaporation surface to the enclosure; and a lower portion which is equipped with means for heat transfer, an emptying valve and a pipe means which is connected to a pumping apparatus and within which is disposed a surface of revolution which is intended for the condensation operation, being fixed sealingly around the whole of its outside periphery and at least over a fraction of its height to the inside wall surface of the enclosure, the interior of said surface communicating the upper portion of the enclosure with the pipe means.

In that apparatus, the condensation surface is at least equal to the evaporation surface in order for the process to retain its entire efficiency in the purification operation.

The description of such an apparatus is facilitated by referring to the accompanying drawing which shows a view in vertical axial section of a specific apparatus.

Shown therein is a cylindrical-conical enclosure of steel which is sealed with respect to the ambient air and which is formed by the following:

a cylindrical upper portion 1 which is heated by means of electrical resistances 2 and provided with agitation means which in this embodiment are formed by a circular coil 3 through which flows an alternating electrical current, lithium supply means 4 and draw-off means 5, a probe 6 for measuring the level of lithium, a blind tube 7 in which a thermocouple is placed, a connection 8 for introducing neutral gas; disposed within that portion is a container 9 of NSMC steel which is internally coated with pure iron, being suspended from the dome of the enclosure by means of supports 10 and containing the lithium bath 11 which has an evaporation surface 12; and a conical bottom portion 13 which has a double casing 14 within which a heat exchange fluid circulates, being fitted in its lower part with a valve 15 for emptying out impurities and on its lateral portion with a pipe means 16 connected to a pumping apparatus (not shown); disposed within that portion is a surface 17 of revolution which is intended for the condensation effect, being fixed sealingly around the whole of its outside periphery along the ring 18 to the inside wall surface of the enclosure and communicating the upper portion of the enclosure with the pipe means. Fixed to that surface is a sheath 19 for housing a thermocouple which is intended to control the condensation temperature.

The mode of operation of such an apparatus is as follows: the enclosure having been purged of the air therein by the introduction at 8 of a flow of argon which can be evacuated by means of the valve, the impure lithium is introduced into the container by the supply means, with the level being followed by means of the probe and being heated by means of electrical resistances to the appropriate temperature that is regulated by the thermocouple disposed in the tube 7. The enclosure is put under a suitable pressure by operation of the pumping apparatus while the lower portion is cooled by passing a cold fluid into the double casing so that the temperature of the condensation surface is maintained at the desired value as controlled by the thermocouple disposed at 19.

The agitation means is then set in operation. The impurities escape at the evaporation surface of the metal bath and the vapours are condensed on the condensation surface.

After a period of agitation which depends on the amount of lithium, the composition thereof and the degree of purity desired, the agitation means and the pumping unit are stopped; the purified lithium is drawn off and the impurities are emptied out by way of the bottom valve 15.

To permit that emptying operation to be carried out, the heat exchange fluid is brought to a temperature which is sufficient to melt the condensed impurities, preferably between 100° and 200°.

The invention may be illustrated by reference to the following example of application thereof:

A charge of 10 kg of lithium containing by weight 200 ppm of sodium and 100 ppm of potassium was treated at 550° C. under a pressure of $1 \cdot 10^{-2}$ Pascal for a period of 6 hours in an apparatus in which the condensation surface area was equal to twice the evaporation surface area. The temperature of the condensation surface as 100° C. 9.95 kg of lithium was recovered, which contained 5 ppm of sodium and 2 ppm of potassium.

The foregoing figures show the efficiency of the process according to the invention which can be used in particular in the purification of lithium intended more particularly for the production of aluminium alloys for aeronautical purposes.

I claim:

1. Apparatus for purifying lithium, comprising a metal enclosure having a wall defining an interior sealed with respect to ambient air, and having upper and lower communicating portions, said upper portion comprising an open container suspended therein for containing lithium to be purified, said container defining a surface area for lithium contained therein, means for supplying lithium to the container, means for removing lithium from the container, means for agitating lithium in the container, means for heating lithium in the container and means for determining the level and temperature of lithium in the container; and said lower portion comprising a heat exchange means associated with the wall thereof for cooling said lower portion and whereby condensing lithium, an emptying means communicating with the interior in said lower portion for removing condensed lithium and including a valve means, a pipe means communicating with the interior in said lower portion and adapted for connection to a pump means for reducing the pressure in said enclosure, and a condensing means for impurities in the form of a surface of revolution having a circumference and a height and defining an interior portion, said condensing means being fixed sealingly over its complete circumference and at least a portion of its height to the interior wall of said enclosure, the interior portion of said condensing means serving as communication between said upper portion said pipe means.

2. Apparatus according to claim 1, wherein the surface area of the condensing means is equal to or greater than the defined surface for lithium in said container.

* * * * *